US005178314A

United States Patent [19]

Radtke et al.

[11] Patent Number: 5,178,314

[45] Date of Patent: Jan. 12, 1993

[54] STAPLING DEVICE FOR SHEETS

[75] Inventors: Manfred Radtke, Korb; Juergen Ries, Nelligen, both of Fed. Rep. of Germany

[73] Assignee: Eastman Kodak Company, Rochester, N.Y.

[21] Appl. No.: 800,304

[22] Filed: Nov. 29, 1991

[30] Foreign Application Priority Data

Jan. 21, 1991 [DE] Fed. Rep. of Germany ..... 9100660

[51] Int. Cl.[5] ..... B27F 7/19

[52] U.S. Cl. ..... 227/110; 227/155; 227/156

[58] Field of Search ..... 227/109, 155, 156, 178, 227/181, 77, 78, 84, 110, 111

[56] References Cited

U.S. PATENT DOCUMENTS

| | | | |
|---|---|---|---|
| 2,716,749 | 9/1955 | Timmerbeil | 227/109 |
| 2,915,754 | 12/1959 | Wandel | 227/111 |
| 4,305,539 | 12/1981 | Korolkov et al. | 227/109 X |
| 4,516,714 | 5/1985 | Braun et al. | 227/111 X |
| 4,605,001 | 8/1986 | Rothfuss et al. | 227/178 |

FOREIGN PATENT DOCUMENTS

| | | | |
|---|---|---|---|
| 637442 | 10/1936 | Fed. Rep. of Germany | 227/155 |
| 688334 | 2/1940 | Fed. Rep. of Germany | 227/155 |

OTHER PUBLICATIONS

RD 15710: Staple Sensing Apparatus; Research Disclosure May 1977 pp. 22, 23.

*Primary Examiner*—Douglas D. Watts
*Assistant Examiner*—Clark F. Dexter
*Attorney, Agent, or Firm*—Tallam I. Nguti

[57] ABSTRACT

A stapling device for stapling various size sheets includes a stapling head that is movable along a travel path for adjusting the various sheet stapling positions. The stapling device includes a plurality of cooperating anvils having first and second surfaces for cooperating with the first and second legs of a staple being used by the stapling head. One of the anvils has a centrally located third cooperating surface that cooperates with the first leg of the staple when the stapling device is in a first sheet stapling position, and with the second leg of the staple when the stapling device is in a second and different sheet stapling position.

3 Claims, 3 Drawing Sheets

STAPLING DEVICE FOR SHEETS

BACKGROUND OF THE INVENTION

1. Field of the Invention

The invention relates to a sheet stapling device comprising at least one stapling head which for adaptation to different sheet formats can be moved in one direction along a travel path so as to be adjusted to various selectable stapling positions, and a plurality of anvils, which cooperate with the stapling head, are arranged in a row extending along the travel path in the adjusting direction, and each of which features or has first and second cooperating surfaces for cooperating with each of the two legs of a staple being ejected from the stapling head during a stapling operation, the cooperating surfaces being successively arranged in the longitudinal direction of the row of anvils.

2. Description Relative to the Prior Art

Stapling devices of this type are known. They are widely used in sheet handling equipment arranged downstream of the sheet exiting stations of copiers, printing machines, etc. Sheet handling equipment used in connection with copiers provided with means for collecting the copy sheets and collating them in sheet stacks in addition to stapling devices are also called finishers. In cases in which the sheets are stapled by means of a stapling device and subsequently folded along the central line to form a brochure or leaflet, the respective sheet handling device is also called a saddle stitcher.

Regardless of the specific design of such stapling devices, usually a first stapling head is fixedly arranged at a predetermined distance from the neighboring top (or bottom) edge of a sheet stack, while a second stapling head is arranged movably with respect to the first head such that it can be positioned equidistantly from the opposite bottom (or top) edge of the stack. The movable stapling head can be locked in these selectable stapling positions by means of releasable detents. The stapling positions are selected so as to correspond to the format steps of the sheet format systems in question, e.g , to the steps A4, A3, etc. with the DIN system or to the steps of the US systems (inch system). The anvils are arranged in a row such that opposite to said first stapling head an anvil with its two first and second surfaces is located, and such that opposite to the second head also an appropriately registered anvil with its two first and second surfaces is located in each of the adjustable stapling positions.

SUMMARY OF THE INVENTION

It is the object of the invention to provide a stapling device of the generic type which is of a particularly simple design.

In a stapling device of the initially mentioned type, the above object is attained in that at least one of the anvils is a tri-surface anvil provided with a third cooperating surface which is successively arranged between its first and second cooperating surfaces. In two different stapling positions selected, the central one, third of said cooperating surfaces of the tri-surface anvil cooperates with a leg of the staple whose other leg cooperates with an outer one of the first of said cooperating surfaces thereof in the first of the two stapling positions selected, and with the other outer one, the second of said cooperating surfaces thereof in the second of the two stapling positions.

Due to the fact that in the stapling device according to the invention a combination anvil is used having more than two surfaces and one of which is effective in any of two different stapling positions, the design problems are avoided that occurred in known devices when two stapling positions to which the second head is adjustable are located relatively close to each other. If this is the case, that is to say, if the displacement path between the two closely adjacent stapling positions of the second stapling head is shorter than the center-to-center distance between two anvils which are to be arranged and registered in a row as close to each other as possible in these positions, the use of only one row of anvils is thus not possible.

In the present invention, however, such problems have been solved in a surprisingly simple way by using a combination tri-surface anvil serving two different stapling positions so that a single row of anvils can be utilized even if the second head is to be adjustable to such closely adjacent stapling positions. As a result, the intended simplification of the design has been achieved by the present invention .

BRIEF DESCRIPTION OF THE DRAWINGS

The invention will now be described in detail with reference to an embodiment shown in the drawings.

DETAILED DESCRIPTION OF THE PREFERRED EMBODIMENT

Figure 1:
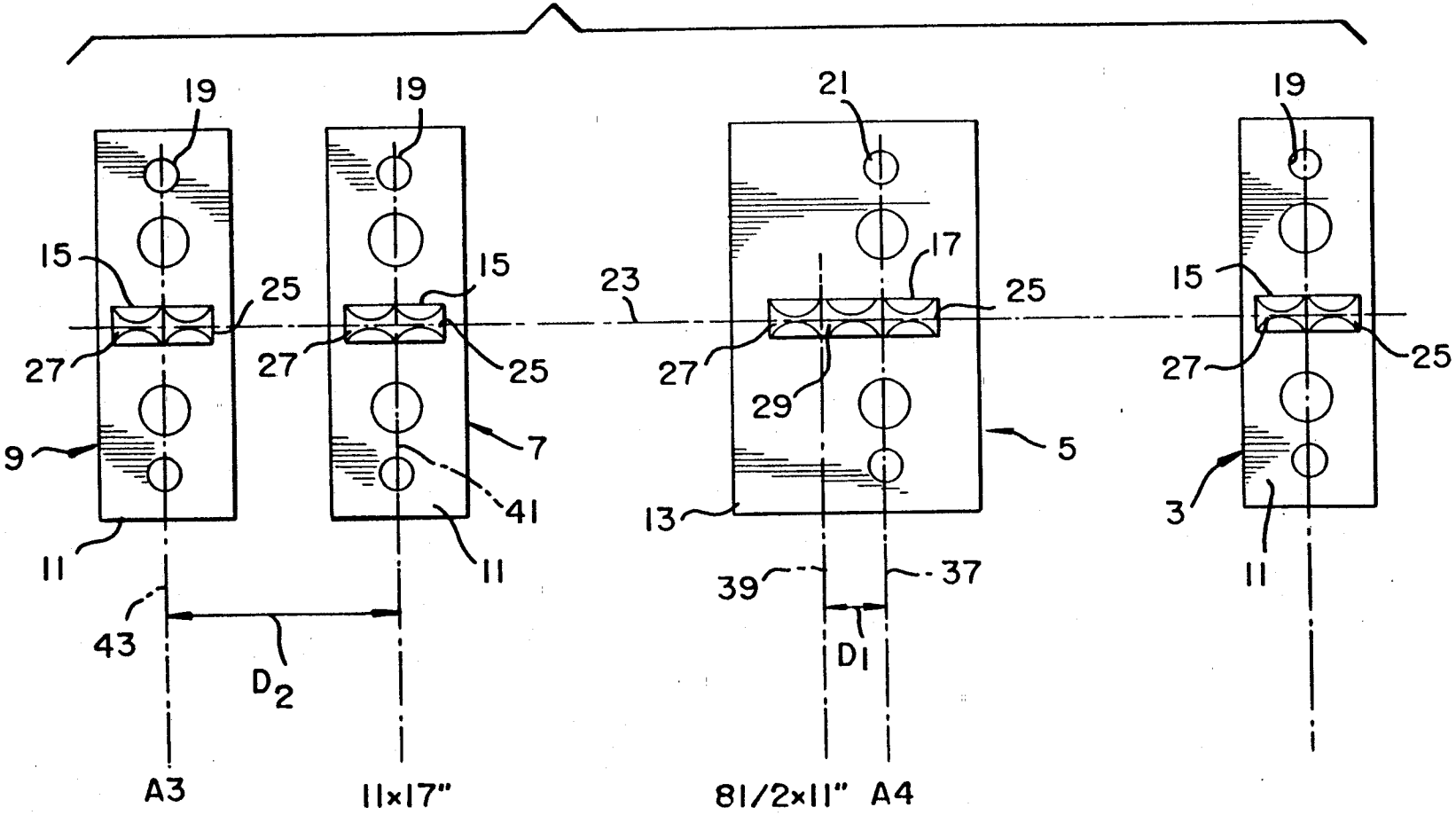
FIG. 1 shows a schematically simplified top view of the row of anvils of the embodiment containing a combination anvil for cooperating with the stapling head in two selectable stapling positions.

A row of anvils shown in FIG. 1 comprises anvils 3, 5, 7 and 9. Anvils 3, 7 and 9 show similarly designed, rectangular metallic base plates 11. Anvil 5 also features a metallic rectangular base plate 13 whose lateral dimension is however larger than with the base plates 11.

Figure 3:
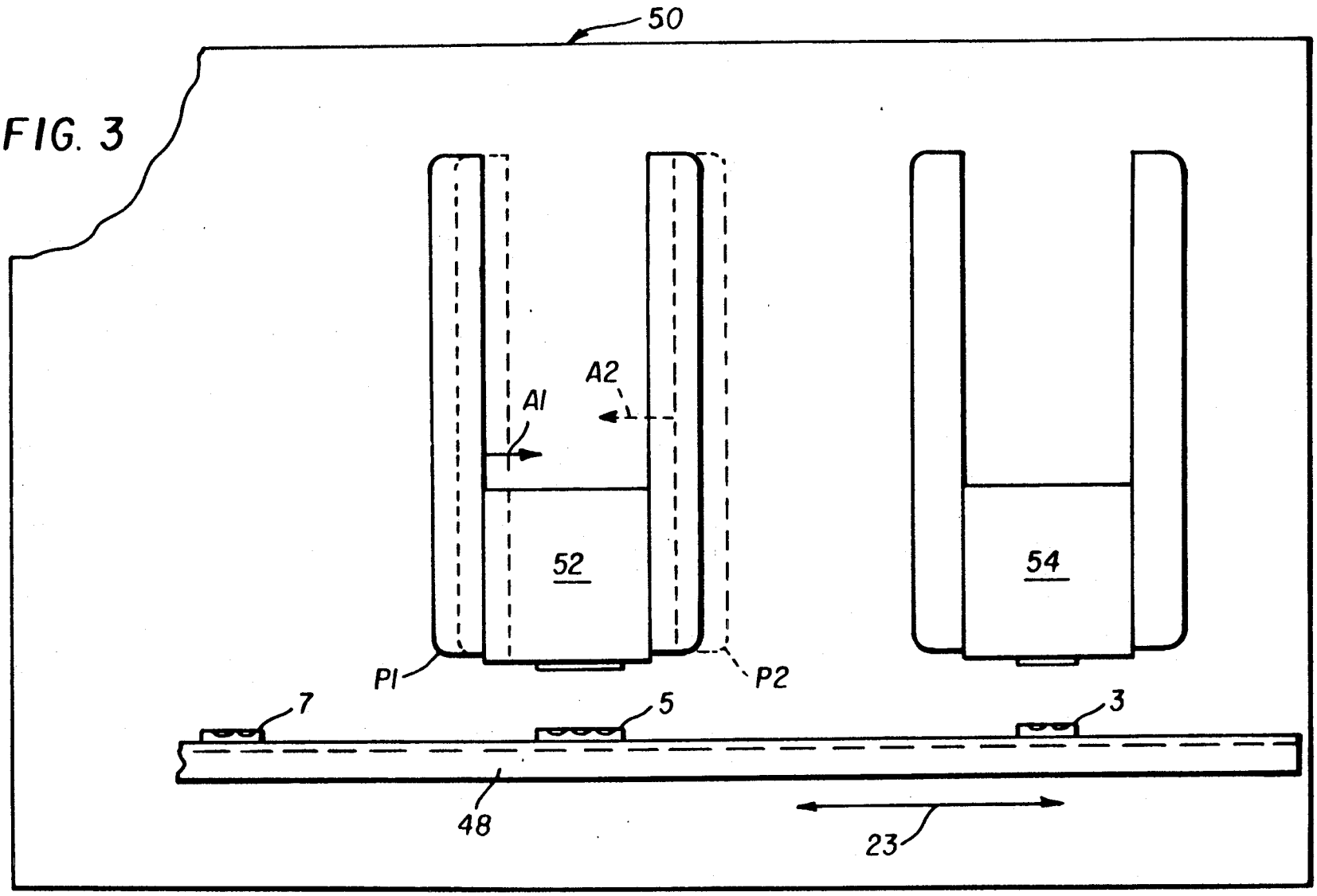
FIG. 3 shows a schematic of the stapling device of the present invention.

By means of screws extending through bores 19 and 21 in the base plates 11 and 13, respectively, the anvils 3, 5, 7 and 9 are fixed to a support shown as 48 (FIG. 3) of the stapling device shown as 50 (FIG. 3) such that along their longitudinal direction designated 23 in FIG. 1 and FIG. 3 they form a straight row of anvils which is oriented so as to extend linearly along the adjusting direction of the stapling head shown as 52 (FIG. 3) which is slidably arranged as shown by arrows A1, A2 (FIG. 3) for adjusting to different stapling positions shown as P1, P2 (FIG. 3). As such, the stapling head 52 is movable relative to the fixed anvils 3, 5, 7 and 9. Base plates 11 and 13 carry on their upper surface (visible in the top view of FIG. 1) anvil bodies 15 and 17 forming the anvils 3, 7, 9 and 5, respectively.

The anvil bodies 15 and 17 are arranged in alignment with the longitudinal direction 23 of the row of anvils.

Anvil 3 is arranged at the end of the row of anvils in a position so that its anvil body 15 is aligned with a stapling head shown as 54 (FIG. 5) stationarily mounted to the stapling device 50. Anvils 7 and 9 are fixed in positions so that their anvil bodies 15 can cooperate with the adjustable stapling head (not illustrated) in two stapling positions, the arrangement of anvil 9 being intended for the stapling position when processing DIN-A 3 format or size sheets, and anvil 7 being intended for the stapling position when processing 11"×17" US sheet size or format.

Figure 2:
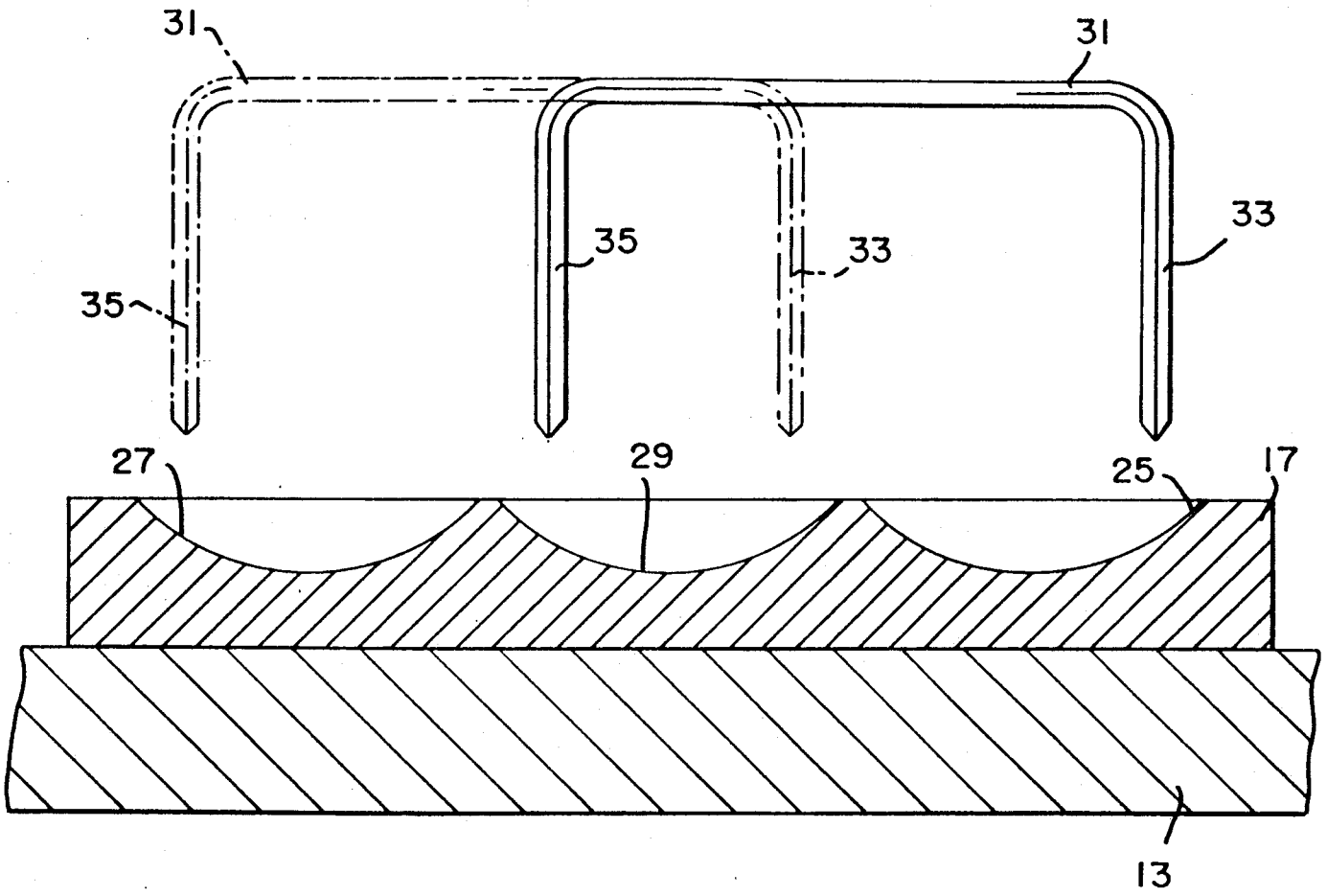
FIG. 2 shows a longitudinal section of the combination anvil in the area of its surfaces which are shown relative to the positions of two staples, said section—as opposed to FIG. 1—being represented at a larger scale.

Anvil 5 whose body 17 is shown in detail in FIG. 2 is designed as a combination anvil intended for cooperation with the adjustable stapling head 52 in any of two different stapling positions shown as P1, P2, i.e. the position for processing DIN-A 4 and the 8½"×11" sheets.

Anvil bodies 15 of anvils 3, 7 and 9 are identically designed and, as is usual with stapling devices, each of them features two surfaces 25 and 27 in the form of elongate, concave depressions which are worked into the surface of anvil body 15 and whose widths are reduced by the spherically curved side walls in the central area.

In addition to the surfaces 25 and 27, the anvil body 17 of combination or tri-surface anvil 5 features a third surface 29 of identical shape located between said surfaces 25 and 27 thereof. As can be inferred from FIG. 2, the surface 29 cooperates in two different stapling positions indicated by different positions of a staple 31 with the legs 33 and 35, respectively, of staple 31. For the DIN-A 4 stapling position, the staple 31 is shown in solid lines and for the 8"×11" U.S. format position in dash-dotted lines. In the embodiment shown in the drawings, the leg 35 on the left side cooperates with the surface 29 when processing DIN-A 4 sheets, whereas the leg 33 on the right-hand side cooperates with the surface 29 when processing the 8½"×11" U.S. format sheets. The outer surfaces 25 and 27 of anvil 5 cooperate with the remaining legs 33 and 35, respectively of staple 31.

Due to the availability of three surfaces 25, 27 and 29, anvil 5 can thus be used for the operation of the stapling head 52 in two different stapling positions P1, P2 located closely adjacent to each other in the adjusting direction 23 of the adjustable stapling head 52. When the stapling device 50 is designed as a saddle stitcher, the length of the adjusting path of the stapling head measured in adjusting direction amounts to 6 mm between the DIN-A 4 and 8½"×11" U.S. format stapling positions. So when changing from one stapling position to the other, the length of $D_1$ (FIG. 1) is 6 mm which is the amount the separating line 37 extending between surfaces 25 and 29, and the separating line 39 extending between surfaces 29 and 27 of anvil body 17 must be spaced apart from each other. In the present embodiment, this corresponds to the length of surface 29 measured in longitudinal direction 23. As a result, the surfaces 25, 29 and 27 on anvil body 17 may be arranged side-by-side. When changing from the 11"×17" U.S. format stapling position to DIN-A 3 position, the spacing measured between the separating lines 41 and 43 of anvils 7 and 9, respectively, amounts to 17.5 mm. This spacing designated $D_2$ in FIG. 1 can technically be easily realized even if using individual anvils 7 and 9.

The above description and the drawings indicate only features essential for the embodiment of the invention by way of example, Inasfar as the features are disclosed in the description and in the drawings and are not mentioned in the claims, they serve, if required, to determine the subject of the invention.

The invention has been described in detail with particular reference to a presently preferred embodiment, but it will be understood that variations and modifications can be effected within the spirit and scope of the invention.

What is claimed is:

1. A stapling device for stapling various size sheets, the stapling device comprising:

at least one stapling head which is movable in a longitudinal direction relative to a stationary anvil along a travel path for adjusting to various selectable sheet stapling positions (P1, P2); and a plurality of stationary anvils (5, 7 and 9), for cooperating with said movable stapling head said plurality of anvils being arranged in a row extending along said travel path, and each anvil of said plurality thereof having first and second surfaces (25, 27) for cooperating with each of a first and second leg (33, 35) of a staple (31) being ejected from said stapling head during a stapling operation, said first and second surfaces (25, 27) being successively arranged in the longitudinal direction (23) of the said row of anvils, said stapling device characterized in that:

at least one (5) of said anvils (5, 7 and 9) is tri-surfaced having a third cooperating surface (29) arranged between said first and second cooperating surfaces (25, 27) thereof defining two different stapling positions; and in that in a first of said two different stapling positions selected, said third (29) cooperating surface of said tri-surfaced anvil (5) cooperates with the first leg (33) of the staple (31) and said first (27) cooperating surface of said tri-surface anvil cooperates with the second leg (35) of said staple (31), and in a second (P2) of said two different stapling positions, the third cooperating surface of said tri-surfaced anvil cooperates with the second leg (35) of the staple and the second (25) (25) cooperating surface thereof cooperates with the first leg (33) of said staple (31).

2. A stapling device 50 according to claim 1, characterized in that the three cooperating surfaces (25, 29, 27) of said tri-surface anvil are arranged immediately adjacent each other.

3. A stapling device (50) for stapling various size sheets, the stapling device comprising:

(a) a stationary stapling head for stapling an end portion of said sheets;

(b) a first stationary anvil having two surfaces, said first anvil being mounted in line with said stationary stapling head for cooperating therewith;

(c) a movable stapling head for stapling a midpoint portion of each of two different size sheets, said midpoint portion comprising two different stapling positions; and (d) a second stationary anvil having three surfaces including a middle surface between two end surfaces, said second anvil being mounted in line with said movable stapling head for cooperating therewith such that at both of said two stapling positions one of the legs of a staple driven by said movable stapling head cooperates with said middle surface of said three surfaces.

* * * * *